US011357307B2

(12) United States Patent
Tanaka

(10) Patent No.: US 11,357,307 B2
(45) Date of Patent: Jun. 14, 2022

(54) COSMETIC APPLICATOR

(71) Applicant: SINWA CORPORATION, Yokohama (JP)

(72) Inventor: Akihiro Tanaka, Yokohama (JP)

(73) Assignee: SINWA CORPORATION, Yokohama (JP)

( * ) Notice: Subject to any disclaimer, the term of this patent is extended or adjusted under 35 U.S.C. 154(b) by 203 days.

(21) Appl. No.: 16/640,721

(22) PCT Filed: Aug. 21, 2017

(86) PCT No.: PCT/JP2017/029744
§ 371 (c)(1),
(2) Date: Feb. 20, 2020

(87) PCT Pub. No.: WO2019/038799
PCT Pub. Date: Feb. 28, 2019

(65) Prior Publication Data

US 2020/0178674 A1 Jun. 11, 2020

(51) Int. Cl.
*A45D 40/26* (2006.01)
*A45D 34/04* (2006.01)

(52) U.S. Cl.
CPC ..... *A45D 34/045* (2013.01); *A45D 34/043* (2013.01); *A45D 40/264* (2013.01); *A45D 40/265* (2013.01)

(58) Field of Classification Search
CPC ..... A45D 34/00; A45D 34/04; A45D 34/042; A45D 34/043; A45D 34/045;
(Continued)

(56) References Cited

U.S. PATENT DOCUMENTS 2,635,271 A * 4/1953 Auten ..... A47L 23/05 401/39
4,108,558 A * 8/1978 Radice ..... A45D 40/06 401/78

(Continued)

FOREIGN PATENT DOCUMENTS

JP S51-98553 A 8/1976
JP S64-43816 U 3/1989

(Continued)

OTHER PUBLICATIONS

Applicant brings to the attention of the Examiner the existence of related U.S. Appl. No. 29/624,583, filed Nov. 2, 2017, which was granted as U.S. Pat. No. D. 854,744 S on Jul. 23, 2019, and which has inventorship and/or ownership in common with the present application.

(Continued)

*Primary Examiner* — David J Walczak
(74) *Attorney, Agent, or Firm* — JTT Patent Services, LLC; Gerald T. Peters

(57) ABSTRACT

A cosmetic applicator capable of being extended and retracted may comprise a shaft having a twofold structure in which there are an outer cylinder having an inner surface on which a projection is provided and an inner cylinder having an outer surface on which a guide groove that guidingly engages with the projection is provided. The guide groove may have two transverse grooves that extend in a circumferential direction and a second longitudinal groove that extends in an axial direction connecting the two transverse grooves. The guide groove may also have a first longitudinal groove that is provided at a location different in the circumferential direction from that of the second longitudinal groove and that extends in an axial direction, from that transverse groove which of the two transverse grooves is (Continued)

nearer a tip having an applying portion, to the tip, for easy removable attachment of the outer cylinder.

4 Claims, 2 Drawing Sheets

(58) Field of Classification Search
CPC .... A45D 34/046; A45D 34/048; A45D 40/26; A45D 40/262; A45D 40/265; A45D 40/267
USPC ..... 401/121, 122, 126–130
See application file for complete search history.

(56) References Cited

U.S. PATENT DOCUMENTS

| | | | | |
|---|---|---|---|---|
| 4,241,743 | A | 12/1980 | Schnabel | |
| D307,063 | S | 4/1990 | Lin | |
| 4,930,919 | A | 6/1990 | Gueret | |
| 4,974,981 | A | 12/1990 | Bennett | |
| D408,592 | S | 4/1999 | Litton | |
| D436,225 | S | 1/2001 | Garofano | |
| 6,309,125 | B1 * | 10/2001 | Peters | A46B 11/0006 401/126 |
| 6,328,495 | B1 | 12/2001 | Gueret | |
| D508,297 | S | 8/2005 | Breidenbach | |
| 7,156,572 | B2 | 1/2007 | Gueret | |
| 7,455,468 | B2 | 11/2008 | Gueret | |
| D693,059 | S | 11/2013 | Tani | |
| D703,052 | S | 4/2014 | Park | |
| D703,053 | S | 4/2014 | Park | |
| D709,379 | S | 7/2014 | Moretti | |
| D741,004 | S | 10/2015 | Kloman | |
| D747,827 | S | 1/2016 | Taha | |
| D748,865 | S | 2/2016 | Hall | |
| 9,247,801 | B2 | 2/2016 | Presche | |
| 9,282,805 | B2 | 3/2016 | Stredak | |
| D806,314 | S | 12/2017 | Hamida | |
| D808,822 | S | 1/2018 | Villarreal | |
| D816,897 | S | 5/2018 | Corsi | |
| D854,744 | S | 7/2019 | Tanaka | |
| 2001/0009630 | A1 | 7/2001 | Panda | |
| 2004/0202502 | A1 | 10/2004 | Gueret | |
| 2005/0232681 | A1 | 10/2005 | Gueret | |
| 2006/0285911 | A1 * | 12/2006 | Demellier | A45D 40/10 401/75 |
| 2007/0110500 | A1 | 5/2007 | Cochran | |
| 2007/0278267 | A1 | 12/2007 | Stierstorfer | |
| 2010/0143021 | A1 | 6/2010 | De Laforcade | |
| 2011/0180095 | A1 | 7/2011 | Chen | |
| 2011/0243639 | A1 | 10/2011 | Francavilla | |
| 2011/0271978 | A1 | 11/2011 | Bae | |
| 2015/0164210 | A1 | 6/2015 | Lou | |
| 2016/0066681 | A1 | 3/2016 | Xavier | |
| 2016/0113378 | A1 | 4/2016 | Castex | |
| 2017/0020267 | A1 | 1/2017 | Hwang | |
| 2018/0344001 | A1 | 12/2018 | Tanaka | |

FOREIGN PATENT DOCUMENTS

| | | | |
|---|---|---|---|
| JP | H1-94804 | A | 4/1989 |
| JP | 2001-151285 | A | 6/2001 |
| JP | 2010-057791 | A | 3/2010 |
| JP | 2013-138760 | A | 7/2013 |
| JP | S61-124210 | U | 5/2018 |
| WO | 2007/027047 | A1 | 3/2007 |
| WO | 2018/221247 | A1 | 12/2018 |

OTHER PUBLICATIONS

Applicant brings to the attention of the Examiner the fact that JP Des. Regn. App. No. 2017-010246 filed on May 15, 2017, to which related U.S. Appl. No. 29/624,583 claims priority (see NPL Cite No. 1) and which has drawings similar in content to those of the present application, issued as JP Des. Regn. Cert. No. 1601837 on Mar. 23, 2018. Where necessary, note that that related U.S. Appl. No. 29/624,583 will serve in lieu of English translation of JP Des. Regn. App. No. 2017-010246.

Applicant brings to the attention of the Examiner the existence of related U.S. Appl. No. 15/992,258, filed May 30, 2018, which published as US 2018 0344001 A1 on Dec. 6, 2018 (see US Pat. App. Pub. Cite No. 14), and which has inventorship and/or ownership in common with the present application.

Applicant brings to the attention of the Examiner the fact that JP Pat. App. No. 2017-106355, to which related U.S. Appl. No. 15/992,258 (see NPL Cite No. 3) claims priority, was filed May 30, 2017 and issued as JP Pat. No. 6383052 B1 on Aug. 24, 2018. Note that JP Pat. App. No. 2017-106355, the priority document in related U.S. Appl. No. 15/992,258, has been retrieved via DAS of related U.S. Appl. No. 15/992,258, and that vhere necessary related U.S. Appl. No. 15/992,258 will serve in lieu of English translation thereof.

Applicant brings to the attention of the Examiner the fact that Intl. App. No. PCT/JP2018/019125 filed on May 17, 2018, which designates the US and which published as WO 2018/221247 A1 on Dec. 6, 2018, is similar in content to JP Pat. App. No. 2017-106355, to which related U.S. Appl. No. 15/992,258 claims priority (see NPL Cite Nos. 3 & 4). Where necessary, note that related U.S. Appl. No. 15/992,258 will serve in lieu of English translation thereof.

International Search Report (ISR) dated Jul. 10, 2018 and International Preliminary Reporton Patentability (IPRP) dated Dec. 3, 2019 in International Application No. PCT/JP2018/019125 filed on May 17, 2018, which published as WO 2018/221247 A1 on Dec. 6, 2018 (see NPL Cite No. 5).

Office Actions dated Sep. 20, 2017, Feb. 6, 2018, and May 15, 2018 in JP Pat. App. No. 2017-106355, to which related U.S. Appl. No. 15/992,258 claims priority (see NPL Cite Nos. 3 & 4).

International Search Report (ISR) dated Nov. 14, 2017 in Intl. App. No. PCT/JP2017/029744 filed on Aug. 21, 2017, which published as WO 2019/038799 A1 on Feb. 28, 2019 and of which the present application is the national stage.

* cited by examiner

COSMETIC APPLICATOR

CROSS-REFERENCE TO RELATED APPLICATION AND INCORPORATION BY REFERENCE

This application is the national stage of International Application No. PCT/JP2017/029744, entitled "Cosmetic Applicator", filed 21 Aug. 2017, the content of which is incorporated herein in its entirety by reference.

TECHNICAL FIELD

This relates to a cosmetic applicator having a shaft that is capable of being extended and retracted.

BACKGROUND ART

Applicators for applying eye shadow, mascara, manicure, and other such cosmetics conventionally include those of the type in which a cap for a bottomed cylindrical container is provided in the form of a cap that is integral with the container. Applicators of this type are such that one end may be inserted within the container when the cap is closed, and such that the cap may be used as the gripped region of the applicator when the cap is removed. To prevent deformation, it is often the case that the applying portion at the tip is above the bottom of the container when the cap is closed, making it difficult to completely use up all of the cosmetic. So as to be able to completely use up the cosmetic, it has been proposed that the shaft of the applicator be made capable of being extended and retracted (see Patent Reference No. 1). Extension and retraction of the shaft also allows for improved comfort during application, which can also lead to improved ease of use.

PRIOR ART REFERENCES

Patent References

Patent Reference No. 1: Japanese Patent Application Publication Kokai No. 2013-138760

SUMMARY OF INVENTION

Problem to be Solved by Invention

However, most applicators which are such that the shaft can be retracted and extended such as at Patent Reference No. 1 are of the threadedly engaged type, it being necessary to rotate the cap or the like in order to cause extension of the shaft. While they have the advantage that the shaft can be extended to the desired length, most are such that when used with the shaft extended they are usually used with the shaft extended to the maximum length so as to facilitate use, and both when extending it so it can be used as well as when retracting it so that it can be stored in the container following application, the cap or the like which is threadedly engaged must be rotated, which is troublesome.

It is an object of the present invention to provide cosmetic applicator having a shaft that can be easily extended and retracted.

Means for Solving Problem

To achieve the aforementioned object, a cosmetic applicator in accordance with the present disclosure is constituted so as to cause a shaft to be capable of being extended and retracted as a result of being provided with a shaft having a twofold structure in which there are an outer cylinder having an inner surface on which a projection is provided; and an inner cylinder having an outer surface on which a guide groove that guidingly engages with the projection is provided; wherein the guide groove has two transverse grooves that extend in a circumferential direction, and a second longitudinal groove that extends in an axial direction connecting the two transverse grooves.

It is preferred that the guide groove have a first longitudinal groove that is provided at a location different in the circumferential direction from that of the second longitudinal groove; and that the first longitudinal groove extend in an axial direction, from that transverse groove which of the two transverse grooves is nearer a tip having an applying portion, to the tip.

It is preferred that the two transverse grooves have retaining means for retaining the outer cylinder in removably attached fashion.

It is more preferred that the projection be semicylindrically shaped.

BENEFIT OF INVENTION

Provision of a cosmetic applicator having a shaft that can be easily extended and retracted is made possible.

EMBODIMENTS FOR CARRYING OUT INVENTION

Embodiment Constitution

Figure 1:
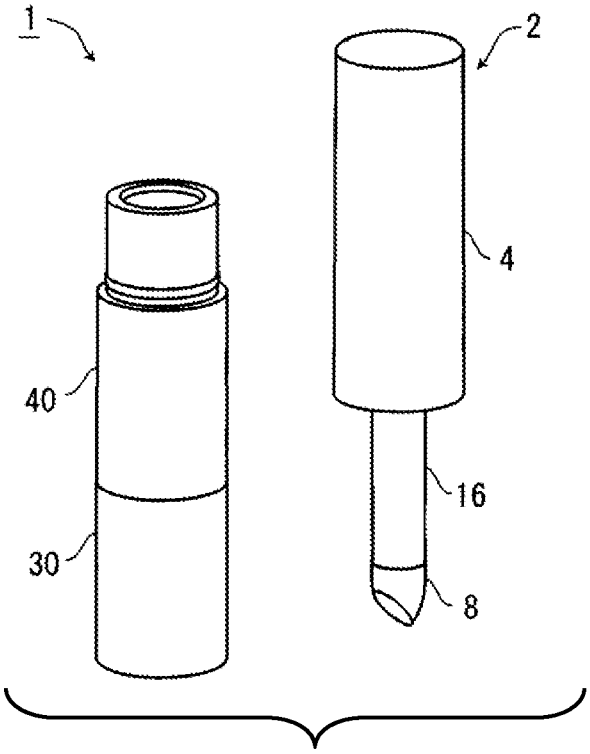
FIG. 1 Perspective view showing a cosmetic container associated with an embodiment of the present invention when the cap is removed.
Figure 2:
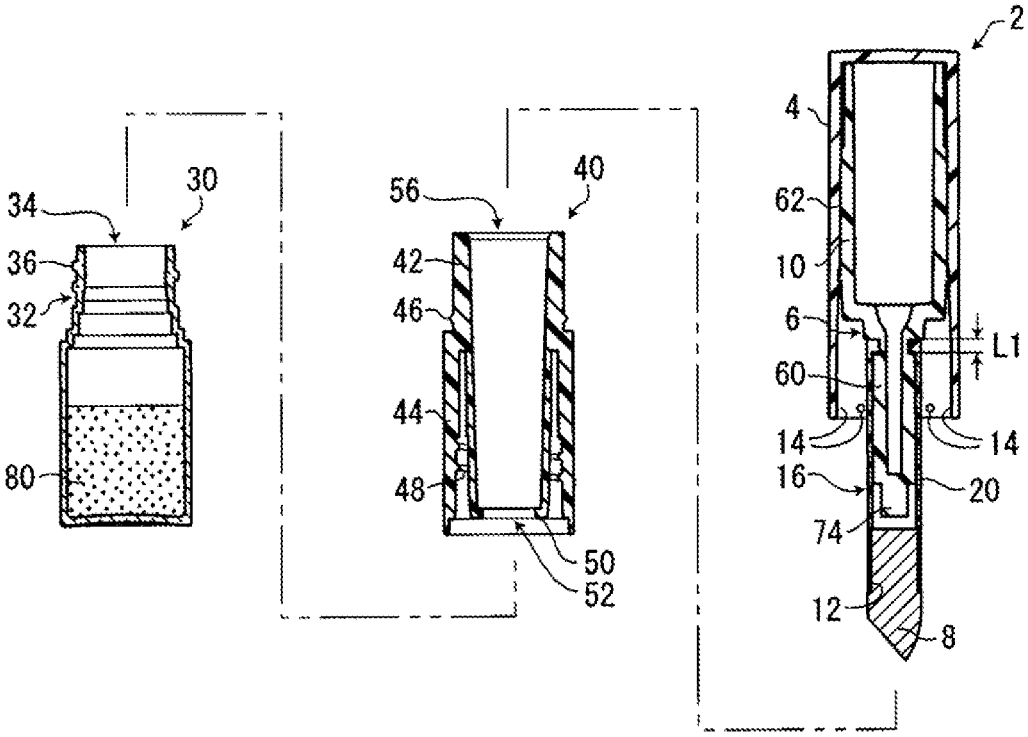
FIG. 2 Front longitudinal sectional view showing a cosmetic container associated with an embodiment of the present invention when disassembled.

Hereinafter, preferred embodiments of a cosmetic applicator according to the present invention are described with reference to the drawings. As shown in FIG. 1 and FIG. 2, cosmetic container 1 is equipped with container body 30 that stores eye shadow or other such powdered cosmetic 80, joint 40 that is threadedly engaged with container body 30 so as to be joined in integral fashion therewith, and applicator body 2 that is removably engaged with joint 40. Applicator body 2 has cap 4 that serves as gripped region, shaft portion 16 that is arranged in hanging fashion at cap 4, and application body 8 that is used in applying cosmetic 80.

Container body 30 is a bottomed cylinder having an upper end portion of reduced diameter, container opening 34 being present at the upper end of this container reduced-diameter portion 32. On an outer circumferential surface of container reduced-diameter portion 32, male threaded region 36 is provided. While there is no particular limitation with respect to the material of container body 30, a transparent or semitransparent material such as plastic or glass is preferably used since it may enable the color, remaining amount, state, etc. of the cosmetic 80 stored therein to be ascertained.

Applicator body 2 is made up of cap 4, base shaft body 6 extending from container body 30 so as to be joined in integral fashion with cap 4, shaft body 20 provided at the outside circumference of base shaft body 6 so as to engage with base shaft body 6, and application body 8 provided at a tip of shaft body 20.

On an inner surface of a lower portion of cap 4, a plurality of cap projections 14 used for engagement with joint 40 are provided in a circumferential direction. By causing these cap projections 14 to ride over annular convex portion 46 which projects in annular fashion from the outer circumferential surface of cylindrical body 42 of joint 40, the applicator body 2 may be attached to or detached from joint 40. Base end portion 10 which is of increased diameter and which is present at the upper portion of base shaft body 6 has rib(s) 62 which are covered thereabove by cap 4 in such fashion as to be joined in integral fashion therewith. Cap 4 serves as a gripped region that is gripped by the user when cosmetic 80 is to be applied.

Base shaft body 6 being hollow, and base shaft portion 60 which makes up shaft 16 being cylindrical, base shaft portion 60 engages with and is entirely covered by shaft body 20, which is in the shape of a cylinder of length greater than that of base shaft portion 60, and of inside diameter approximately equal to the outside diameter of base shaft portion 60. Application body 8 is captured by and secured to tip opening 12 of shaft body 20.

Application body 8 is in the shape of a bullet, the tip of which has been partially truncated in oblique fashion. With a flat portion and a curved portion, and a narrow portion and a thick portion, it is possible to carry out many subtly different types of application using a single application body. Application body 8 is not limited to this shape, and may have any shape such as a bullet shape, a spherical shape, a truncated cone shape, a columnar shape, etc., as long as it can be secured to tip opening 12 and made to engage with bottom hole 52 of joint 40. The material of application body 8 is preferably a soft material such as NBR, urethane, silicone, and/or the like, but it is also possible to use sponge-like substance(s) and/or other such material(s) obtained by foaming any of the foregoing, a continuously porous material such as RUBYCELL (registered trademark of Toyopolymer Co., Ltd.), brush-like material(s), and/or the like.

Joint 40 has a cylindrical body 42 that is open at the top, an inner surface that increases in diameter as one proceeds toward the top, and a bottom surface 50 that is provided with a bottom hole 52 in a central region thereof. On an outer circumference of cylindrical body 42, a cylindrical cover portion 44 larger in diameter than the cylindrical body 42 is provided. Provided on an inner circumferential surface of a lower portion of cover portion 44 is female threaded region 48 that is capable of threaded engagement with male threaded region 36 of container body 30. When female threaded region 48 of joint 40 and male threaded region 36 of container body 30 are threadedly engaged, cylindrical body 42 enters container opening 34, and bottom hole 52 serves as inlet/outlet for cosmetic 80. Application body 8 is such that the diameter at the widest portion thereof is greater than the diameter of bottom hole 52, the length of shaft portion 16 being chosen so as to cause it to be located at a position where it will engage with bottom hole 52 of joint 40 when the cap 4 is attached thereto. The inner surface of cylindrical body 42 is larger in diameter than shaft body 20, such that when cap 4 is attached to upper opening 56 of joint 40, shaft body 20 enters cylindrical body 42, and application body 8 engages with bottom hole 52. Application body 8 closes bottom hole 52 in such fashion as to leave no gap, application body 8 serving to plug bottom hole 52 and prevent cosmetic 80 from scattering. The tip of application body 8 is disposed so as to be above the top surface of the cosmetic 80 filled therewithin.

Structure by which Extension and Retraction are Accomplished

Figure 3:
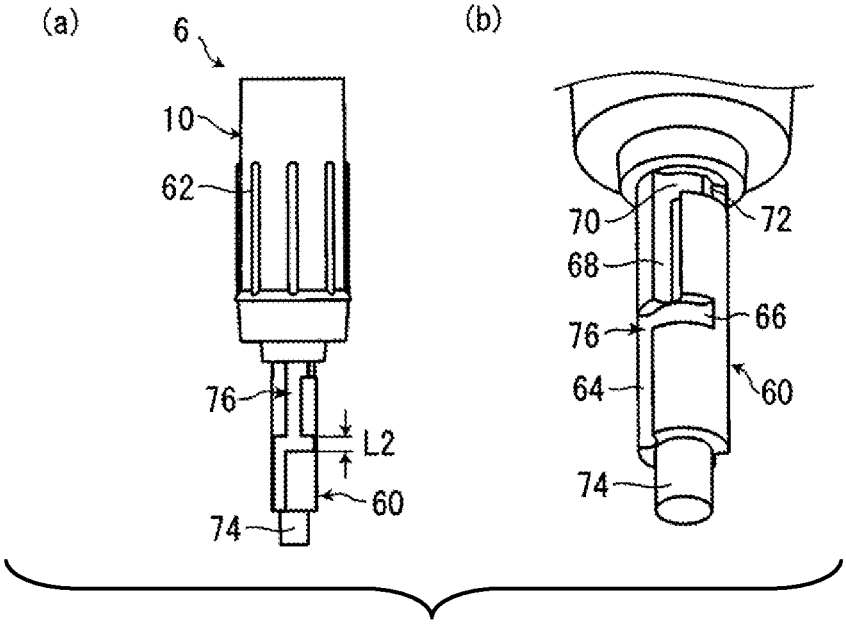
FIG. 3 Body of base shaft of cosmetic container associated with an embodiment of the present invention, (a) being a front view thereof, and (b) being an enlarged perspective view of the base shaft portion thereof.

Shaft portion 16 of applicator body 2 is capable of being extended and retracted, the structure by which this is accomplished now being described. As shown in FIG. 3, guide groove 76 is provided on the surface of base shaft portion 60 of base shaft body 6. This guide groove 76 is made up of first longitudinal groove 64 which is provided in such fashion as to extend from the tip of base shaft portion 60, along the axial direction (long direction) of base shaft portion 60, to a location midway along base shaft portion 60; first transverse groove 66 which is provided in such fashion as to bend to the right from the end of first longitudinal groove 64 and extend in the circumferential direction for a length on the order of ⅓ of the full circumference; second longitudinal groove 68 which is provided in such fashion as to extend in the axial direction toward the side opposite first longitudinal groove 64 from a location in the vicinity of the center of first transverse groove 66 to base end portion 10; and second transverse groove 70 which is provided in such fashion as to bend to the right, i.e., in the same circumferential direction as first transverse groove 66, from the endpoint of second longitudinal groove 68 and extend for a length on the order of ⅓ of the full circumference. Another set of these grooves is provided at locations respectively rotated 180° therefrom.

Figure 4:
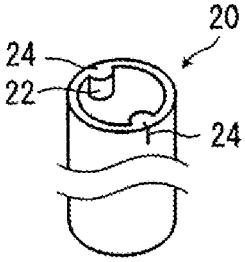
FIG. 4 Perspective view of a shaft body associated with an embodiment of the present invention.

As shown in FIG. 4, shaft body projections 22 for engaging with guide groove 76 and allowing movement along guide groove 76 are provided on an inner surface at an upper portion of shaft body 20. Shaft body projections 22 are semicylindrically shaped, two thereof being provided, at locations in the circumferential direction causing them to face one another, and in such fashion that the long directions (axial directions) thereof are parallel to the axial direction of shaft body 20. The shape of guide groove 76 corresponds to the semicylindrical shape of shaft body projection 22, the cross-sectional shapes of first longitudinal groove 64 and second longitudinal groove 68 being semicircular, and the corners at the ends of first transverse groove 66 and second transverse groove 70 being rounded.

When assembling shaft body 20 on base shaft portion 60, shaft body projections 22 are aligned with the tips of first longitudinal grooves 64 and are made to slide along and engage with guide grooves 76. So as to facilitate engagement by shaft body 20, cylindrical portion 74 of diameter smaller than the inside diameter of shaft body 20 is provided at the tip portion of base shaft portion 60. Furthermore, small shaft body grooves 24 serving as reference marks are provided at outer surface portions of shaft body projections 22 so as to facilitate alignment in the circumferential direction. Raised peak 72 is provided at a location near the end (dead end) of second transverse groove 70 so as to produce a click sensation when shaft body projection 22 engages with the end of second transverse groove 70 and shaft body 20 is retained by base shaft portion 60. During normal use, shaft body 20 is retained in this position.

When the user wishes to use this with shaft portion 16 extended, shaft body 20 is made to move along guide groove 76 so that it is retained by the end of first transverse groove 66. Because the end of first transverse groove 66 narrows slightly, height L2 (see FIG. 3) at the end thereof being slightly less than height L1 (see FIG. 2) of shaft body projection 22, shaft body 20 is held in place by the friction at the top and bottom faces of shaft body projection 22. Shaft portion 16, which is made up of the twofold structure of shaft body 20 and base shaft portion 60, is made capable of extension and retraction by virtue of these guide grooves 76 and shaft body projections 22.

Operation and Effect

To apply cosmetic 80 to the skin or the like, cosmetic container 1 is repeatedly shaken in such fashion that it is turned upside-down so as to cause cosmetic 80 to adhere to application body 8, cap 4 being gripped so as to permit this to be pulled out from joint 40 and used. When there is little cosmetic 80 remaining, by removing joint 40, extending shaft portion 16, and causing cosmetic 80 to be applied to application body 8, it will be possible to completely use up all of cosmetic 80. Or when there is a desire to cause cosmetic 80 to adhere to application body 8 in amount(s) and at location(s) suiting one's preference, or a desire to elevate the perception of use or the ease of use, or the like, it is also possible to extend shaft portion 16 so that it can be used in accordance with one's preference. It being possible for shaft 16 to be elongated merely by causing shaft body 20 to move along guide groove 76, both extension and retraction are easily performed, and shaft body 20 can be held in place at the extended/retracted location(s), without having to go to the trouble of causing rotation such as would be the case with the threadedly engaged type of device.

Because first longitudinal groove 64 and second longitudinal groove 68 are not collinear but are provided at mutually different locations in the circumferential direction, this makes it possible to avoid situations in which shaft body 20 might otherwise accidentally come all the way off after being pulled out partway.

Furthermore, among applicators having shafts that can be extended and retracted, unlike those of the type for which assembly is difficult, or those of the type for which it is the case that once it has been assembled it is then removal that poses a problem, the structure by which extension and retraction are accomplished is simple, the parts count is low, assembly is easy, and removal is also easy. Because shaft body 20 can be removed merely by causing it to move along guide groove 76, it can easily be replaced by another shaft body 20 having an application body 8 of different shape so that this may be used, making it possible to cause cosmetic 80 to be applied by an application body 8 in accordance with one's preference. Furthermore, if application body 8 should ever become deformed or solidified, the entire shaft body 20 may easily be replaced with a new part. Whereas with replacement of only the application body 8 at the tip there might be concern that application body 8 could come apart during use, because the entire shaft body 20 to which application body 8 is secured is replaced, there is no concern that application body 8 will fall off therefrom.

Furthermore, the ends of first transverse grooves 66 narrow and peaks 72 are present at second transverse grooves 70 so as to make it possible for guide grooves 76 to removably hold shaft body projections 22 in place. By causing application body 8 to be such that shaft body 20 which is present at the tip thereof is capable of being held in place by base shaft portion 60, it is possible to prevent situations in which shaft portion 16 might otherwise move by itself and cause cosmetic 80 to be applied to unintended locations during use. By causing both transverse grooves (66, 70) to have means for retaining shaft body 20, it will be possible to prevent shaft body 20 from moving both when the shaft is in its extended state and when the shaft is in its retracted state.

Shaft body projection 22 is semicylindrical in shape, making it easier to cause shaft body 20 to be engaged and held in place by base shaft portion 60. Whereas it would be necessary to align the corners at two points were the projection in the shape of a rectangular parallelepiped, engagement is facilitated inasmuch as it is need only be aligned at the one point at the vertex of the semicircle. Furthermore, when causing shaft body projection 22 of shaft body 20 to be held in place by transverse groove(s), because the planar portions at the top and bottom faces are used, it is possible to cause it to be securely held in place. Particularly when causing shaft body projection 22 to engage with and be retained by the end of first transverse groove 66, while there would be concern that retention might become loose were shaft body projection 22 spherical or the like, because the fact that it is in this shape makes it possible for two faces, i.e., the top face and bottom face, to be used, it is possible to cause friction to be high such that this can be tightly held in place.

Shaft portion 16 is a twofold structure employing two cylinders, i.e., an outer cylinder and an inner cylinder, application body 8 being present at the tip of shaft body 20 which is the outer cylinder. Where shaft body 20 which is capable of being elongated is the inner cylinder at which application body 8 is present, shaft body 20 can be pulled out to permit it to be used; and when causing it to be returned to where it was, while there is a risk that cosmetic 80 will enter the interior of the outer cylinder and that the hands or the surroundings will become soiled, the possibility of this occurring is less than would be the case with the reverse construction.

Variations

Figure 5:
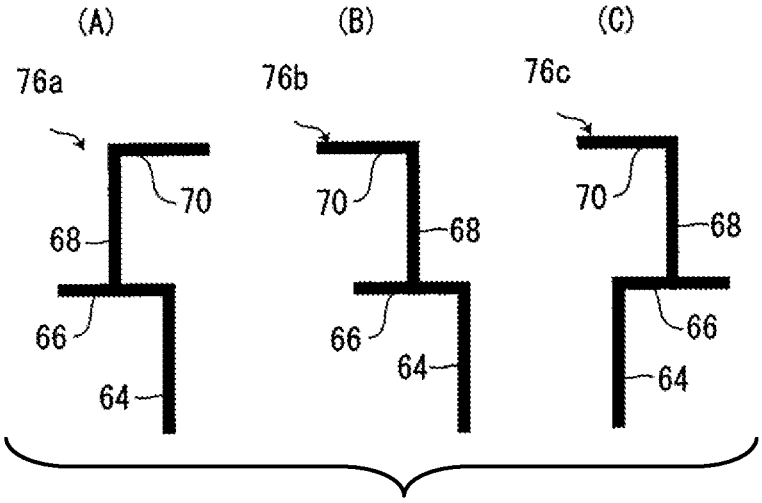
FIG. 5 Variation on a guide groove associated with an embodiment of the present invention.

FIG. 5 shows variations on guide groove 76. Guide groove **76*a* differs from guide groove 76 in that first transverse groove 66 extends in such fashion as to bend in the opposite direction (to the left) as second transverse groove 70. Guide groove 76 was such that because the directions of the endpoints (dead ends) at which shaft body projection 22 is retained by first transverse groove 66 and second transverse groove 70 were the same, regardless of whether the intention was to cause shaft portion 16 to be extended or to cause shaft body 20 to be removed, it was possible by rotating shaft body 20 to the right to cause it to be held in place or by rotating it to the left to cause it to be released, which was easy for the user to understand. Because shaft portion 16 provided with guide groove 76*a* is such that it can be extended by turning shaft body 20 slightly to the left while pulling on it from where it is ordinarily retained at second transverse groove 70, and it can be returned to its original location by turning it to the left while pushing on it, extension and retraction are easily accomplished. It being required for removal that it first be rotated to the left and thereafter rotated in the opposite direction, it is not easily removed. It is favorably used as an applicator that is frequently extended and retracted. Guide groove 76*b* being of such shape as to be bilaterally symmetrical with respect to guide groove 76, and guide groove 76*c* being of such shape as to be bilaterally symmetrical with respect to and guide groove 76*a*, because these are respectively such that causing shaft body 20 to rotate in the reverse threaded direction (to the right) causes it to be removed, right-handed users will find shaft body 20** hard to remove but left-handed users will find it easy to remove. These may respectively be used depending on the goal.

Whereas in the present embodiment a powdered cosmetic was used as cosmetic 80, it is also capable of being used with manicure, mascara, or other such liquid cosmetics or solid cosmetics. Whereas the present embodiment was provided with joint 40, a constitution may also be adopted in which there is no joint 40, and applicator body 2 is removably attached directly to container body 30. The applicator may also by itself be made to have functionalities permitting extension and retraction, and attachment and removal.

Whereas shaft body projection 22 was retained by friction at the end of cosmetic container first transverse groove 66, it may be retained by causing a peak 72 to be provided in the same manner as at second transverse groove 70. Or another structure capable of causing it to be retained may be employed.

Furthermore, it is preferred that the number of transverse grooves at guide groove 76 be increased so as to permit extension and retraction to be carried out in any number of steps. Whereas first transverse groove 66 was provided at a location midway along base shaft portion 60, it may be provided at a location near the tip so as to increase the length by which this may be extended and retracted.

EXPLANATION OF REFERENCE NUMERALS

1 Cosmetic container
2 Applicator body
4 Cap
6 Base shaft body
8 Application body
10 Base end portion
12 Tip opening
14 Cap projections
16 Shaft portion
20 Shaft body
22 Shaft body projection
24 Shaft body groove
30 Container body
32 Container reduced-diameter portion
34 Container opening
36 Male threaded region
40 Joint
42 Cylindrical body
44 Cover portion
46 Annular convex portion
48 Female threaded region
50 Bottom surface
52 Bottom hole
56 Upper opening
60 Base shaft portion
62 Ribs
64 First longitudinal groove
66 First transverse groove
68 Second longitudinal groove
70 Second transverse groove
72 Peak
74 Cylindrical portion
76, 76*a*, 76*b*, 76*c* Guide grooves
80 Cosmetic

The invention claimed is:

1. A cosmetic applicator characterized in that it is provided with a shaft having a twofold structure in which there are an outer cylinder having an inner surface on which a projection is provided; and an inner cylinder having an outer surface on which a guide groove that guidingly engages with the projection is provided;

wherein the guide groove has first and second transverse grooves that extend in a circumferential direction, the first transverse groove being that transverse groove which of the two transverse grooves is nearer to a tip having an applying portion and the second transverse groove being that transverse groove which of the two transverse grooves is farther from the tip;

the guide groove has first and second longitudinal grooves that extends in an axial direction;

the first longitudinal groove extends in the axial direction from the first transverse groove to the tip;

the second longitudinal groove is provided at a location different in the circumferential direction from that of the first longitudinal groove; and the second longitudinal groove connects a center of the first transverse groove and an end of the second transverse groove.

2. The cosmetic applicator according to claim 1 characterized in that the first and second transverse grooves have retaining means for retaining the outer cylinder.

3. The cosmetic applicator according to claim 1 characterized in that the projection is semicylindrically shaped.

4. The cosmetic applicator according to claim 1 characterized in that the first and second transverse grooves have retaining means for retaining the outer cylinder; and the projection is semicylindrically shaped.

* * * * *